US007861507B2

(12) United States Patent
Maekawa et al.

(10) Patent No.: US 7,861,507 B2
(45) Date of Patent: Jan. 4, 2011

(54) HIGH-STRENGTH PRESTRESSING STRAND, METHOD FOR MANUFACTURING THE SAME, AND CONCRETE CONSTRUCTION USING THE SAME

(75) Inventors: Tomoya Maekawa, Itami (JP); Toshihiko Niki, Itami (JP); Takashi Ichiki, Itami (JP)

(73) Assignee: Sumitomo (SEI) Steel Wire Corp., Itami-Shi, Hyogo (JP)

( * ) Notice: Subject to any disclaimer, the term of this patent is extended or adjusted under 35 U.S.C. 154(b) by 481 days.

(21) Appl. No.: 11/993,454

(22) PCT Filed: Feb. 21, 2007

(86) PCT No.: PCT/JP2007/053154

§ 371 (c)(1),
(2), (4) Date: Dec. 20, 2007

(87) PCT Pub. No.: WO2007/097354

PCT Pub. Date: Aug. 30, 2007

(65) Prior Publication Data

US 2010/0108197 A1 May 6, 2010

(30) Foreign Application Priority Data

Feb. 23, 2006 (JP) ..... 2006-046892

(51) Int. Cl.
*D02G 3/02* (2006.01)

(52) U.S. Cl. ..... 57/212

(58) Field of Classification Search ..... 57/212, 57/236

See application file for complete search history.

(56) References Cited

U.S. PATENT DOCUMENTS 3,847,002 A 11/1974 Suzuki et al.

(Continued)

FOREIGN PATENT DOCUMENTS

JP 5-163688 6/1993

(Continued)

OTHER PUBLICATIONS

Office Action in Korean Patent Application No. 9-5-2009-000732311 and partial English translation thereof, dated Jan. 7, 2009 (11 pages).

(Continued)

*Primary Examiner*—Shaun R Hurley
(74) *Attorney, Agent, or Firm*—Osha Liang LLP

(57) ABSTRACT

In one aspect, the present disclosure relates to a high-strength prestressing strand having a seven-wire structure in which one core wire and six outer wires are stranded. An external diameter of the strand is from 15.0 mm to 16.1 mm, a total cross-sectional area of the strand is 135 $mm^2$ or more, and a load at 0.2% permanent elongation is 266 kN or more. A relaxation value measured after a 1000-hour relaxation test is 2.5% or lower and a diameter of the core wire is 5.35±0.3 mm and a diameter of the outer wires is 5.15±0.25 mm. The core wire and the outer wires each have a composition of at least 0.90% carbon. The prestressing strand is manufactured by stranding the core wire and outer wires, giving a stretching treatment, and giving a bluing treatment at a temperature of 380° C. or more and 430° C. or less after or at the same time with the stretching treatment.

3 Claims, 1 Drawing Sheet

U.S. PATENT DOCUMENTS

2003/0106300 A1* 6/2003 Bruyneel et al. ..... 57/212

FOREIGN PATENT DOCUMENTS

| | | |
|---|---|---|
| JP | 10-77587 | 3/1998 |
| JP | 10-331330 | 12/1998 |
| JP | 11-050597 | 2/1999 |
| JP | 2003034892 A | 2/2003 |
| JP | 2003-113585 | 4/2003 |
| JP | 3684186 | 6/2005 |

OTHER PUBLICATIONS

Korean Industrial Standards "KS D 7002" and partial English translation thereof, published Dec. 31, 2002 (17 pages).

Patent Abstracts of Japan, Publication No. 11-050597, Publication Date Feb. 23, 1999 (1 page).

Extended European Search Report for European Application No. 07714654.6-2314, dated Mar. 25, 2010 (6 pages).

Anonymous, "ASTM A 416/A416M-06 Standard Specification for Stell Strand, Uncoated Seven-Wire for Prestressed Concrete", ASTM International (5 pages).

Anonymous, "JIS G 3536" Internet Article retrieved from URL:http://www.concretemiddleeast.com/Portals/41/documents/precastandhollowcore/JISG3536.pdf>, retrieved Sep. 3, 2009 (1 page).

Patent Abstract of Japan, Publication No. 2003034892, Publication Date Feb. 7, 2003 (1 page).

International Search Report for PCT/JP2007/053154 mailed May 29, 2007 (2 pages).

"Practical Use of Ultra-high Strength Prestressing Strand" Authors: Tomoya Maekawa et al. of Sumitomo Electric SEI Technical Review, No. 64 Apr. 2007 (5 pages).

Patent Abstracts of Japan 05-163688 dated Jun. 29, 1993 (1 page).

Patent Abstracts of Japan 10-077587 dated Mar. 24, 1998 (1 page).

Patent Abstracts of Japan 10-331330 dated Dec. 15, 1998 (1 page).

Patent Abstracts of Japan 2003-113585 dated Apr. 18, 2003 (1 page).

Anonymous, JIS G 3502 "Piano wire rods", dated 2004, and an English language translation thereof (12 pages).

Anonymous, prEN 10138-3.2:2005(E) "Prestressing steel - Part 3: Strand", dated Sep. 2005 (12 pages).

* cited by examiner

HIGH-STRENGTH PRESTRESSING STRAND, METHOD FOR MANUFACTURING THE SAME, AND CONCRETE CONSTRUCTION USING THE SAME

TECHNICAL FIELD

The present invention relates to a high-strength prestressing strand made by stranding a plurality of cold-drawn wires, a method for manufacturing the high-strength prestressing strand, and a concrete construction using the high-strength prestressing strands.

BACKGROUND ART

In the case of domestic use, a prestressing strand is usually made by cold-drawing wires satisfying Japanese Industrial Standard (JIS) G 3502, stranding the wires, and giving a bluing treatment in order to remove residual strain thereof in the final step of the production. A prestressing strand satisfying the JIS G 3536 standard is usually used. In the case of non-domestic use, a prestressing strand is made from wires satisfying an appropriate standard (for example prEN10138), and the prestressing strand satisfying the appropriate standard is used. If strengths of those prestressing strands can be increased, the flexibility of structural design and the strength of a concrete construction using the strands will also be enhanced. That is, a prestressing strand having a decreased diameter can be used and an insertion pitch of the prestressing strands can be increased.

For example, in Patent document 1, a prestressing strand is proposed that is composed of 19 stranded wires and has a standard diameter of 19.3 mm, as specified in JIS G 3536. A tensile load of the prestressing strand (PC strand) significantly exceeds the lower limit specified in the standard, while the proposed prestressing strand has the same strand configuration and external diameter as a strand specified in the standard and a total cross-sectional area substantially equal to the nominal cross-sectional area specified in the standard.

[Patent document 1] Japanese Patent No. 3684186

However, when the tensile load applied to the prestressing strand described in Patent document 1 is significantly increased, it is extremely difficult to achieve a 0.2% permanent elongation load value and a relaxation value based on which the strand would be classified as a low relaxation strand as specified in the JIS G 3536 standards, while preventing the toughness from being deteriorated by strain aging during a wire drawing process. Moreover, a proposed prestressing strand having such a low 0.2% permanent elongation load value is not so suitable for practical use, and judging from the situations in which prestressing strands have been used in recent concrete constructions, there is little existence value for such a prestressing strand that cannot exhibit the desired relaxation value for a low-relaxation product.

DISCLOSURE OF INVENTION

Problem to be Solved by the Invention

An object of the present invention is to provide a high-strength prestressing strand that has a higher strength and is more suitable for practical use than known prestressing strands, and to provide a concrete construction using the prestressing strands.

Means for Solving the Problem

To solve the above-mentioned problems, the high-strength prestressing strand of the present invention is made from seven wires stranded, one being a core wire and six being outer wires. The prestressing strand has an external diameter of 15.0 mm to 16.1 mm, a total cross-sectional area not less than 135 $mm^2$, and a 0.1% or 0.2% permanent elongation load not less than 266 kN.

For a seven-wire strand having a standard diameter of 15.2 min specified in the JIS G 3536 standard or 15.7 mm specified in a non-domestic standard (such as prEN10138), prestressing strands can have higher strength and be more suitable for practical use than known strands, by producing a prestressing strand having the same configuration and external diameter as a strand specified in the standard, and having a total cross-sectional area that is substantially equal to the specified nominal cross-sectional area, and by controlling the 0.2% or 0.1% permanent elongation load value to exceed the lower limit (222 kN) of the standards by 20% or more. Note herein that, the reason why the range of the total cross-sectional area is limited to within the above-mentioned range is that if the total cross-sectional area is less than 135 $mm^2$, it will become difficult for each of core and outer wires to maintain the required tensile strength. In addition, if the 0.1% or 0.2% permanent elongation load is less than 266 kN, the prestressing strand will have a strength only slightly higher than that of known strands, and a strength of a concrete construction and a flexibility of structural design using the prestressing strand would be less enhanced.

In the configuration described above, by controlling a relaxation value so as not to exceed 2.5% after a 1000-hour relaxation test, the prestressing strand can satisfy the value of a low-relaxation strand specified in the JIS G 3536 or non-domestic standards (such as prEN10138), so that the prestressing strand can be applied to a wider range of applications.

It is desirable that a diameter of the core wire is 5.35±0.3 mm and that of the outer wires is 5.15±0.25 mm. If the diameter of the core or outer wires is outside of this range, it is difficult to form a prestressing strand having an acceptable external diameter, that is, the standard diameter of 15.2 mm specified in the JIS G 3536 standard or 15.7 mm specified in the non-domestic standard (such as prEN10138).

It is desirable to use steel wires containing carbon in an amount of 0.90 wt % or more as the core and outer wires. Steel wires containing carbon in an amount less than 0.90 wt % make it difficult to maintain the required strength of the prestressing strand.

In order to make a high-strength prestressing strand having the above-mentioned structure, the core and outer wires are stranded and then given a stretching treatment. After the stretching treatment or at the same time, the wires are given a bluing treatment at a temperature of 430° C. or lower, so that the relaxation value is suppressed to 2.5% or less and the 0.2% or 0.1% permanent elongation load value is 266 kN or more without difficulty.

If high-strength prestressing strands having the above-mentioned structure are used in a concrete construction, the strength and the flexibility of structural design of the construction are more enhanced than those of a known construction.

Advantages of the Invention

As mentioned above, the prestressing strand of the present invention has higher strength than a known strand so as to be suitable for practical use, because the 0.2% permanent elongation load value exceeds the lower limit of the JIS standard and the 0.1% permanent elongation load value exceeds the limit of non-domestic standards (such as prEN10138). Also, by controlling relaxation characteristics to satisfy a specification value of the JIS or non-domestic standards (such as prEN10138), the prestressing strand can be applied to a wider range of applications.

A method for manufacturing a high-strength prestressing strand of the present invention ensures production of a prestressing strand having the above-mentioned characteristics.

Also, a concrete construction of the present invention has a higher strength and flexibility of structural design than a known construction, because the concrete construction of the present invention uses the high-strength prestressing strand having the characteristics mentioned above.

BEST MODE FOR CARRYING OUT THE INVENTION

An embodiment of the present invention will now be described with reference to the drawings. A high-strength prestressing strand of the embodiment has a seven-wire structure including one core wire (diameter: 5.25 mm) and six outer wires (diameter: 5.05 mm) stranded together. An external diameter of the prestressing strand is 15.35 mm and the total cross-sectional area of the prestressing strand is 142 $mm^2$. The strand configuration, the external diameter, and the total cross-sectional area of the prestressing strand are in accordance with a seven-wire strand having a standard diameter of 15.2 mm specified in JIS G 3536. The core wire and outer wires are steel wires containing 0.90-1.3 wt % C, 0.5-1.2 wt % Si, 0.1-1.0 wt % Mn, 0.05-1.5 wt % Cr, and the balance being Fe and inevitable impurities. A 0.2% permanent elongation load value is controlled to 266 kN or more, and a relaxation value after a 1000-hour relaxation test is controlled to 2.5% or less.

The method for manufacturing the prestressing strand is as follows. First, element wires (diameter: 13.0 mm) containing above-mentioned components are given a patenting treatment so as to control the strength thereof to 1490-1550 MPa and then cold-drawn with a continuous wire drawing machine having nine dies so that the element wires are made to have desired diameters of the core wire and outer wire. Then the core and outer wires are stranded, given a stretching treatment, and given a bluing treatment at a temperature of 430° C. or lower. The stretching treatment is performed by applying a proper tensile load to the stranded wires between two capstans provided during the stage of the wire stranding process. In the bluing treatment, the stranded wires are heated for 2-3 seconds under high frequency in a furnace and then passed through a water-cooling bath. When the stranded wires are between the furnace and the bath, they are air-cooled for several seconds.

Figure 1:
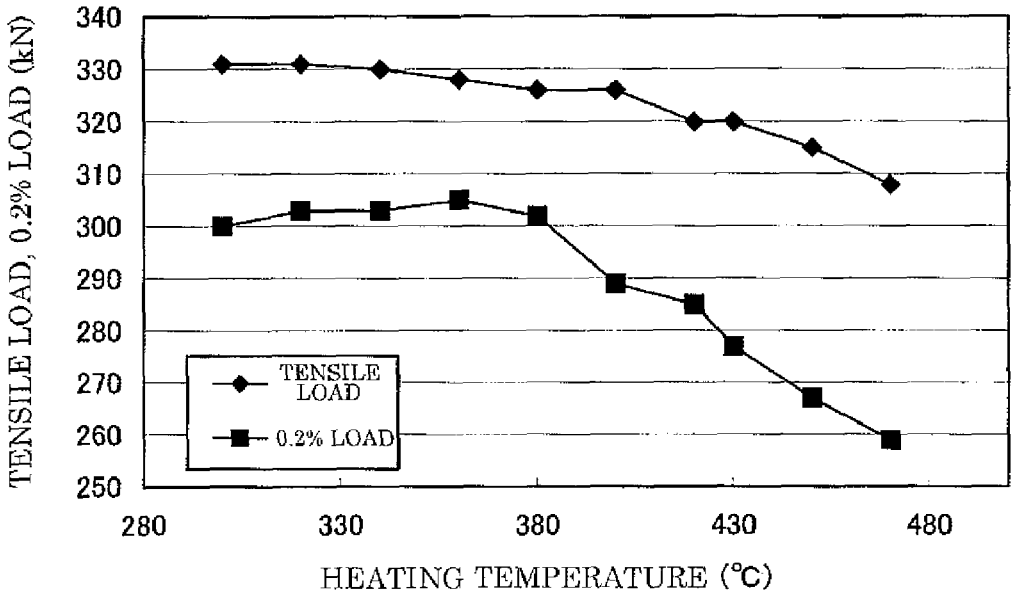
FIG. 1 is a graph indicating the relationship between a heating temperature and a tensile load, and the relationship between the heating temperature and the 0.2% permanent elongation load of the prestressing strand of an embodiment.
Figure 2:
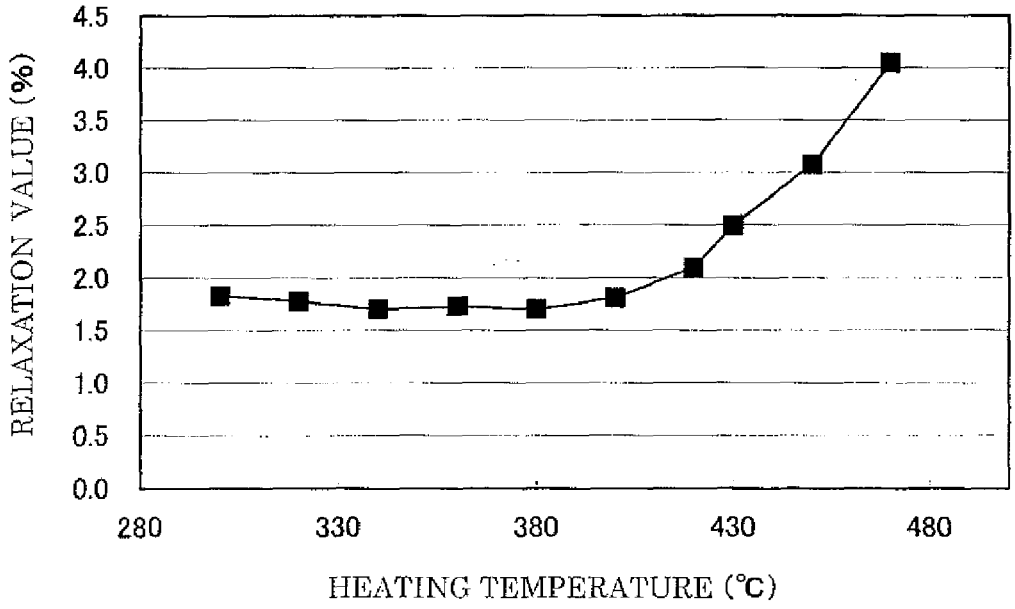
FIG. 2 is a graph indicating the relationship between a heating temperature and a relaxation value of the prestressing strand of the embodiment.

FIGS. 1 and 2 show results of experiments on the effect of the heating temperature during the bluing treatment in the above-mentioned manufacturing method. FIG. 1 shows relationships between a heating temperature and the 0.2% permanent elongation load (hereinafter referred to as "0.2% load") and between the heating temperature and the tensile load. FIG. 2 shows a relationship between the heating temperature and the relaxation value. Here, the heating temperature is measured at a surface of the strand using a radiation thermometer, and the relaxation value is measured after the 1000-hour relaxation test.

As clearly shown in FIGS. 1 and 2, when the heating temperature is 300° C. to 380° C. during the bluing treatment, both of the 0.2% load and the relaxation value of the strand are stable. When the heating temperature, however, exceeds 380° C., the 0.2% load begins to decrease and when the temperature exceeds 400° C., the relaxation value begins to increase. Note herein that, however, when the heating temperature is 450° C. or lower, the 0.2% load is not less than 266 kN and when the heating temperature is 430° C. or lower, the relaxation value can be suppressed to 2.5% or lower.

Therefore, in a practical manufacturing process, as described above, the heating temperature during a bluing treatment is controlled to be 430° C. or lower (preferably 380° C. or lower). For example, when the heating temperature is 380° C., according to the results shown in FIGS. 1 and 2, the 0.2% load is 302 kN. This value exceeds the lower limit of the standard (222 kN) specified in JIS G 3536 for seven-wire strands having a standard external diameter of 15.2 mm by about 36%. Also, the relaxation value is 1.70% and the value is lower than the upper limit of the standard (2.5%) specified in JIS G 3536 for low-relaxation strands by 30% or more. In addition, the tensile load of the strand treated under the heating temperature of 430° C. or lower exceeds the lower limit of the standard (261 kN) specified in JIS G 3536 by 20% or more.

Further, when a concrete construction using these prestressing strands was manufactured, the construction showed a significant enhancement in both strength and flexibility of structural design.

The invention claimed is:

1. A high-strength prestressing strand having a seven-wire structure in which one core wire and six outer wires are stranded, wherein an external diameter of the strand is from 15.0 mm to 16.1 mm, a total cross-sectional area of the strand is 135 $mm^2$ or more, a load at 0.2% permanent elongation is 266 kN or more, wherein a relaxation value measured after a 1000-hour relaxation test is 2.5% or lower, wherein a diameter of the core wire is 5.35±0.3 mm and a diameter of the outer wires is 5.15±0.25 mm, wherein the core wire and the outer wires each comprise a carbon concentration of 0.90% or more, and wherein the prestressing strand is manufactured by:

stranding the core wire and outer wires;

giving a stretching treatment; and giving a bluing treatment at a temperature of 380° C. or more and 430° C. or less after or at the same time with the stretching treatment.

2. A concrete construction using a high-strength prestressing strand according to claim 1.

3. A method of manufacturing a high-strength prestressing strand having a seven-wire structure in which one core wire and six outer wires are stranded, comprising:

stranding the core wire and outer wires;

giving a stretching treatment; and giving a bluing treatment at a temperature of 380° C. or more and 430° C. or less after or at the same time with the stretching treatment, wherein an external diameter of the strand is from 15.0 mm to 16.1 mm, a total cross-sectional area of the strand is 135 $mm^2$ or more, a load at 0.2% permanent elongation is 266 kN or more, wherein a relaxation value measured after a 1000-hour relaxation test is 2.5% or lower, wherein a diameter of the core wire is 5.35±0.3 mm and a diameter of the outer wires is 5.15±0.25 mm, and wherein the core wire and outer wires each comprise a carbon concentration of 0.90% or more.

* * * * *